US006926001B2

(12) United States Patent
Bartley

(10) Patent No.: US 6,926,001 B2
(45) **Date of Patent: *Aug. 9, 2005**

(54) OVEN RACK

(75) Inventor: Robert J. Bartley, Stevensville, MT (US)

(73) Assignee: Barson Enterprises, Inc., Stevensville, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/705,803

(22) Filed: Nov. 10, 2003

(65) Prior Publication Data

US 2004/0094143 A1 May 20, 2004

Related U.S. Application Data

(63) Continuation-in-part of application No. 09/782,232, filed on Feb. 12, 2001, now Pat. No. 6,644,302, which is a continuation-in-part of application No. 09/567,662, filed on May 9, 2000, now Pat. No. 6,205,997.

(51) Int. Cl.[7] ..... F24C 15/16

(52) U.S. Cl. ..... 126/337 R; 126/337 A; 211/153

(58) Field of Search ..... 126/337 R, 337 A, 126/332, 333, 338, 339; 211/181.1, 153, 134; 312/280, 281, 351, 410

(56) References Cited

U.S. PATENT DOCUMENTS

| | | | | | |
|---|---|---|---|---|---|
| 737,671 | A | * | 9/1903 | Spicer | 126/332 |
| 1,350,330 | A | | 8/1920 | Partonnar | |
| 1,398,725 | A | * | 11/1921 | Kneier | 126/337 R |
| 1,941,301 | A | | 12/1933 | Hanson et al. | |
| 1,997,432 | A | * | 4/1935 | Replogle | 126/337 R |
| 2,006,385 | A | * | 7/1935 | Dikeman | 126/339 |
| 2,189,240 | A | * | 2/1940 | Burr | 126/337 R |
| 2,751,486 | A | * | 6/1956 | Evans | 219/391 |
| 2,806,467 | A | | 9/1957 | Slaughter | |
| 3,450,025 | A | * | 6/1969 | Fleming | 126/337 R |
| 4,476,848 | A | * | 10/1984 | Protas | 126/337 R |
| 5,447,146 | A | | 9/1995 | Nickerson | |
| 5,938,968 | A | | 8/1999 | Ogg et al. | |
| 6,148,813 | A | * | 11/2000 | Barnes et al. | 126/339 |
| 6,205,997 | B1 | * | 3/2001 | Bartley | 126/337 R |

FOREIGN PATENT DOCUMENTS

| | | |
|---|---|---|
| FR | 1016946 | 11/1952 |
| GB | 827796 | 2/1960 |

* cited by examiner

*Primary Examiner*—Josiah C. Cocks
(74) *Attorney, Agent, or Firm*—Saliwanchik, Lloyd & Saliwanchik

(57) ABSTRACT

An oven rack has a notch along its periphery. Flat items placed on the rack traversing the notch can be easily removed from the oven without having to first slide the rack from the oven. The oven rack can be adjustable to fit a variety of oven sizes. A handle can be included on the rack to assist in pulling the rack from the oven, if desired.

11 Claims, 12 Drawing Sheets

OVEN RACK

CROSS-REFERENCE TO A RELATED APPLICATION

The subject application is a continuation-in-part of application Ser. No. 09/782,232, filed Feb. 12, 2001 now U.S. Pat. No. 6,644,302 which is a continuation-in-part of Ser. No. 09/567,662, filed May 9, 2000, now U.S. Pat. No. 6,205,997.

BACKGROUND OF THE INVENTION

The convenience of free delivery often makes ordering a pizza a more attractive alternative than making one at home. The availability of gourmet and professional equipment, such as pizza stones, however have made preparing an authentic pizzeria-style pizza at home a possibility. A pizza stone cooks the pizza evenly providing a continuous source of heat and the stone absorbs moisture to provide a crispy crust.

Pizza stones are flat having no lip or edge to grab when removing the stone from the oven. Thus, in order to remove a stone, or any other flat item, from an oven, it is necessary to pull the rack out of the oven, reach behind the stone and push the edge of the stone over the lip of the oven rack, and then push the rack back into the oven before grabbing the stone. When the rack is pulled out of the oven, it is only partially supported and can tilt either falling from the oven or dumping its hot contents onto the floor. Additional safety concerns arise when, at home, children and animals are underfoot.

Oven shelves have been designed to address a number of problems encountered in cooking and baking in an oven. For example, Ogg et al. (U.S. Pat. No. 5,938,968) describe a retractable shelf for a microwave oven to assist the cook in accessing foods which have to be turned or stirred while cooking. Slaughter (U.S. Pat. No. 2,806,467) describes an oven shelf with an insulated handle so the rack can be removed without donning an oven mitt. Hanson et al. (U.S. Pat. No. 1,941,301) describe a tray holder which facilitates withdrawal of a tray from the oven and allows the raising and lowering of that tray within the oven. Each of these racks, although useful for its intended purpose, do not address the problem of removing flat items safely from an oven rack.

All patents, patent applications, provisional patent applications and publications referred to or cited herein, or from which a claim for benefit of priority has been made, are incorporated by reference in their entity to the extent they are not inconsistent with the explicit teachings of the specification.

SUMMARY OF THE INVENTION

The invention is an oven rack which has a notch along its peripheral surface. Items placed into the oven, on the rack, with an edge extending over that notch can be easily removed from the oven without having to slide the rack out of the oven. In a preferred embodiment, this notch is placed on the front of the rack toward the door, near the center and is about 3 inches to about 9 inches wide by about 3 inches to about 9 inches deep allowing adequate room for a hand covered by an oven mitt to reach into the notch and access items on the rack. The oven rack can further include a handle to assist in pulling the rack from the oven. Additionally, the rack can be adjustable to fit a variety of sizes of ovens.

DETAILED DISCLOSURE OF THE INVENTION

The oven rack of the subject invention has a notch along its periphery. The notch allows flat items to be removed from the oven without having to pull the rack from the oven.

Figure 1A:
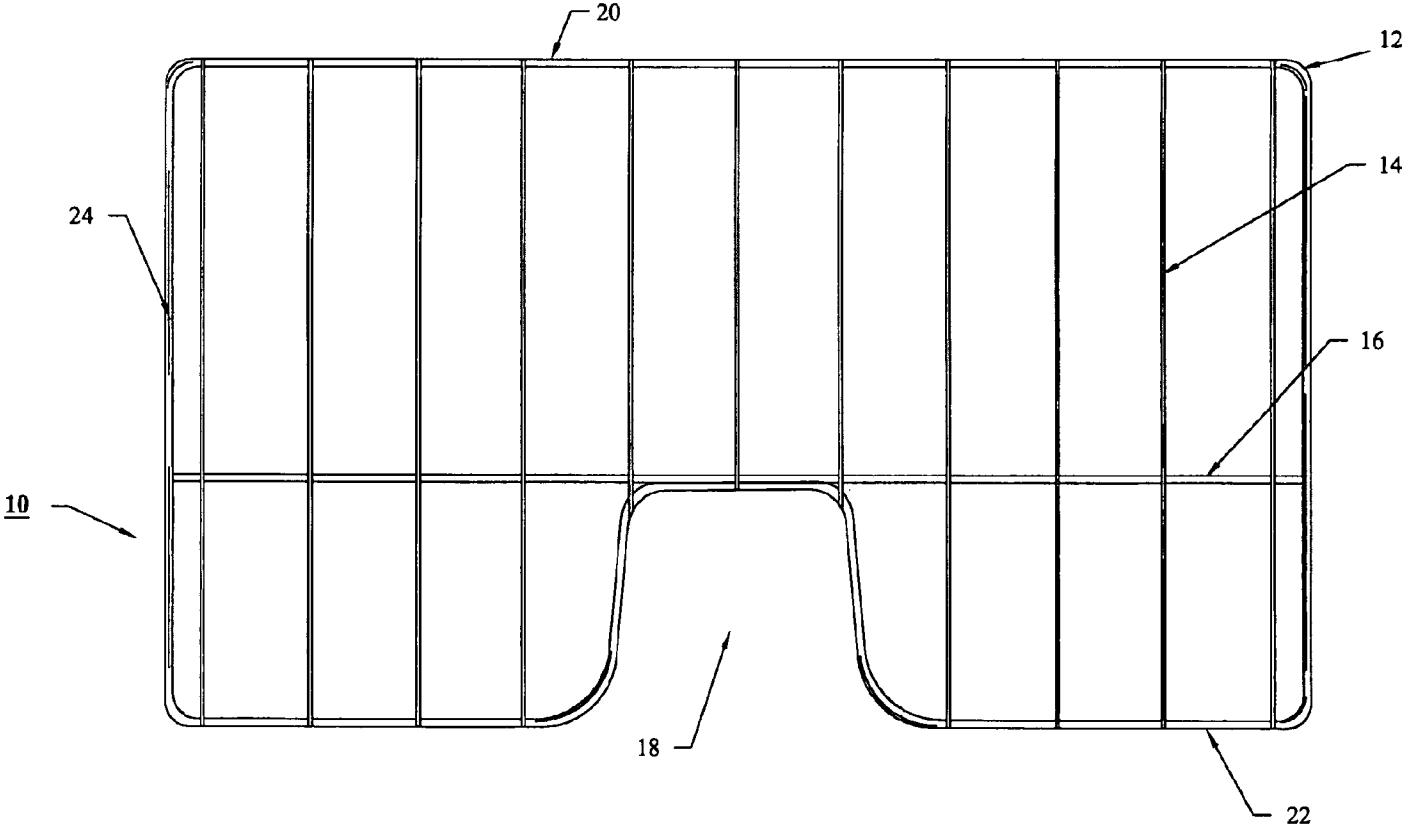
FIG. 1A is a top plan view of a preferred embodiment of the oven rack of the subject invention.
Figure 1B:
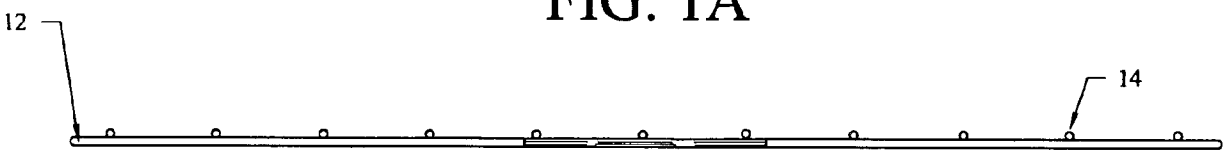
FIG. 1B is an elevational view of the tail edge of a preferred embodiment of the oven rack of the subject invention.

A preferred embodiment of the oven rack 10 of the subject invention is shown generally at 10 in FIG. 1A. The rack is defined by a frame 12 supporting a plurality of bars 14 and an optional cross-member 16. The frame 12 has a notch 18 in its periphery.

Figure 5:
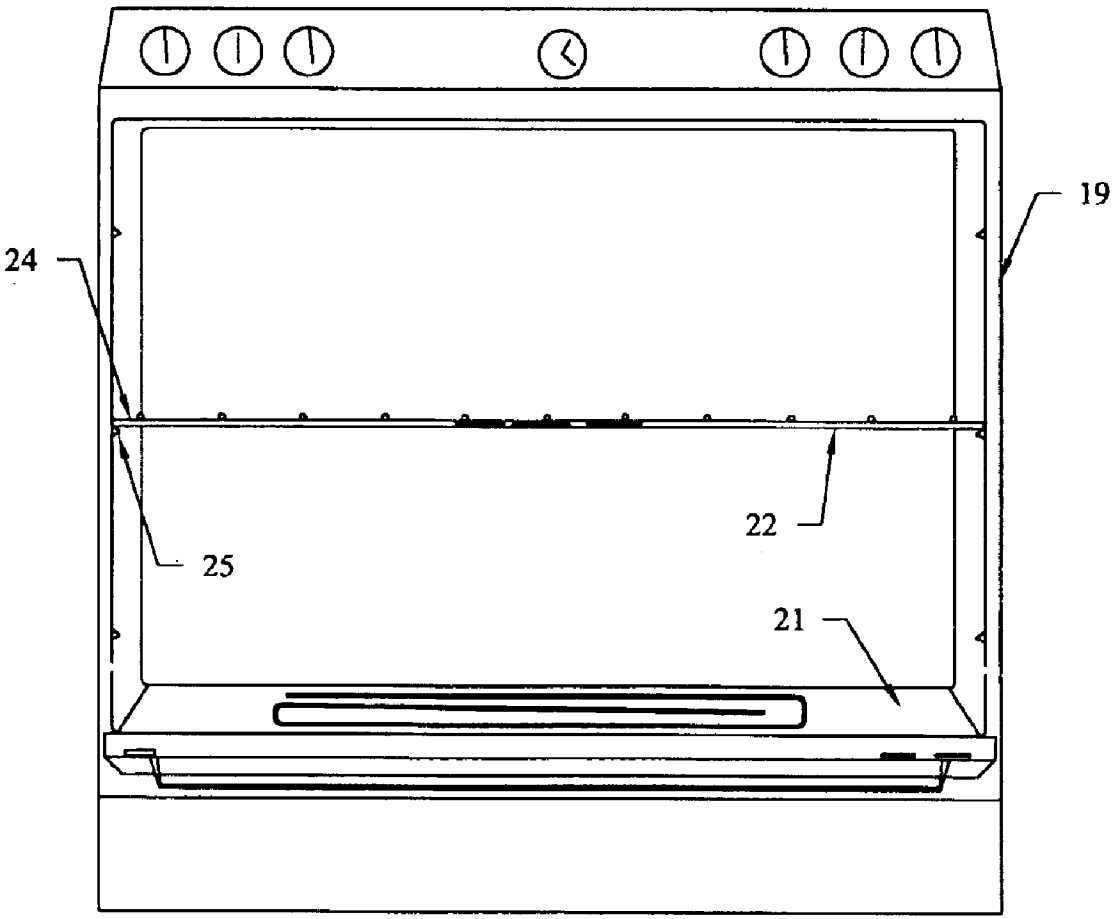
FIG. 5 is a front elevational view of an oven with a preferred embodiment of the oven rack of the subject invention.

In the exemplified embodiment, the rack of the subject invention is used in an oven 19 FIG. 5). A conventional oven is a closed box having a top, bottom and four sides. A door 21 on one side of the box accesses the oven. In place in the oven, the rack of the subject invention has a leading edge 20, tail edge 22, and two side edges 24. The rack is supported in the oven by the sides 24 which engage tracks 25 usually integrally formed from the oven wall. The leading edge 20 slides into the oven and rests against the side opposite the door. The tail edge 22 of the rack faces the oven door.

The frame and bars of the rack of the exemplified embodiment are made from steel which provides adequate strength to support items such as cake pans, pizza stones and casseroles and withstands the heat of an oven. The frame 12 was created by bending a ¼ inch steel bar. Steel bars (⅛ inch) were cut to size and spot welded on the frame as bars 14.

The rack of the subject invention can be used in settings other than in an oven. For example, the rack of the subject invention could be used in a freezer unit. Materials suitable for constructing a rack to be used in a freezer unit could include plastic coated wire. The materials from which the racks are constructed must be appropriate for the intended use of the rack and possess the desired supporting strength. These suitable materials can include, but are not limited to, plastics, other metals, such as aluminum, or organic materials. It is important to note, the frame 12, the bars 14 and the cross-member 16 need not be constructed from the same materials.

The size of the frame 12 of the rack of the subject invention also depends upon the intended use of the rack. In the exemplified embodiment, the rack is sized to slide into or replace a rack of a conventional oven. Likewise, the bars 14 are spaced to accommodate cookware. The frame can be made larger to fit commercial ovens or sized to fit any apparatus in which the racks are to be used. The bars of the rack can be spaced appropriately within the frame to hold any designated item.

Figure 10:
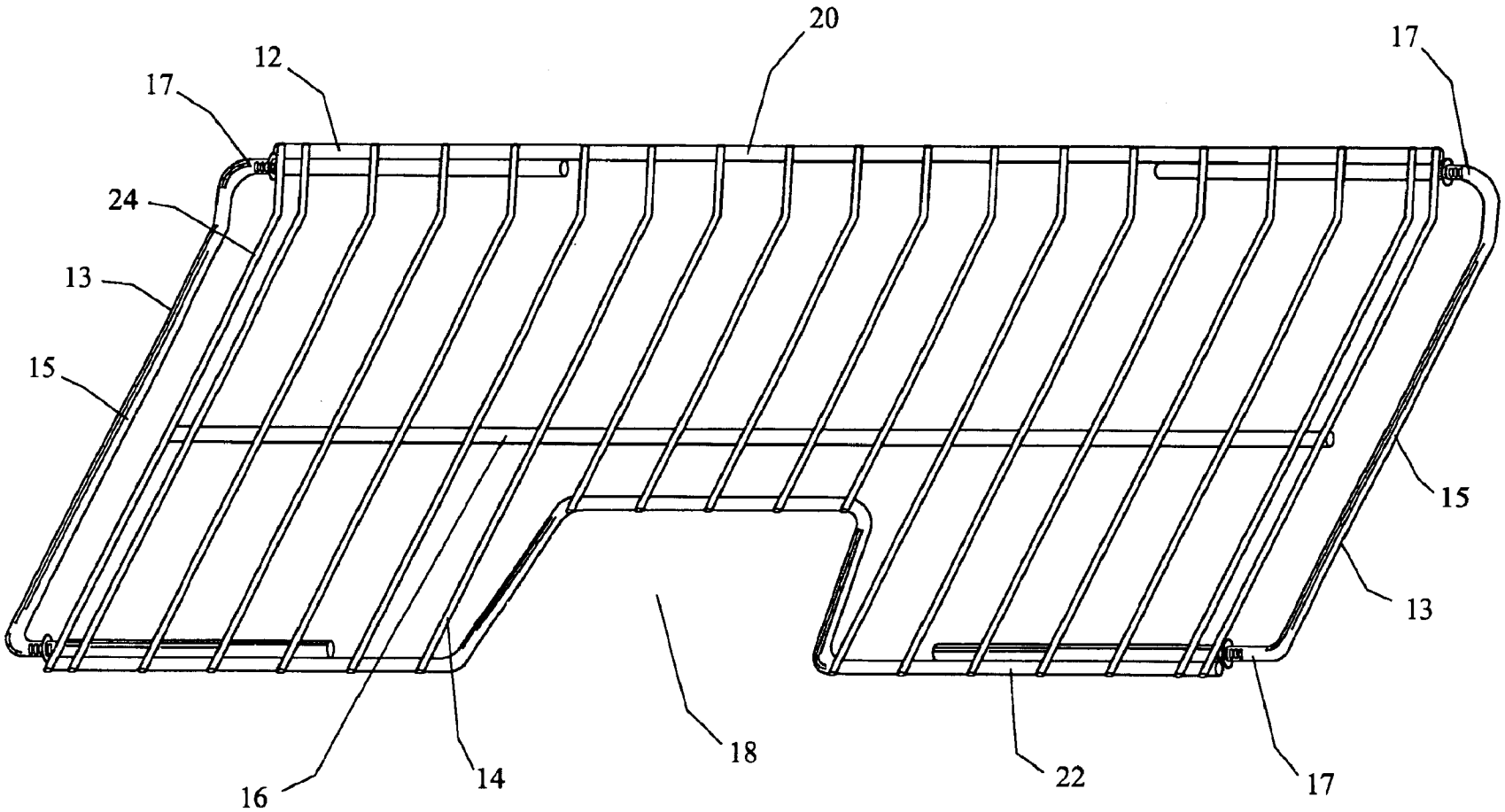
FIG. 10 is a top perspective view of another preferred embodiment of the oven rack of the subject invention.

In a particularly preferred embodiment, the rack of the subject invention is adjustable to accommodate the many sizes of conventional ovens. Adjustability of rack width allows the rack to be sold as an aftermarket product. A user can buy the rack and place it in the user's own oven no matter the size, make or brand of that oven. In a preferred embodiment, the means for adjusting the size of the rack include providing at least one sliding side rail 13 along a side of the frame 12 (FIG. 10). The side rail 13 has a body 15 and two legs 17. The body 15 lays parallel to a side edge 24 of the rack and each leg 17 slidably engages the leading edge 20 and the tail edge 22 of the frame 12. The body 15 contacts the tracks 25 on the inside of the oven wall to support the rack inside the oven. The depth of the subject rack can likewise be adjusted by providing a sliding rail along the leading edge of the rack.

Figure 11:
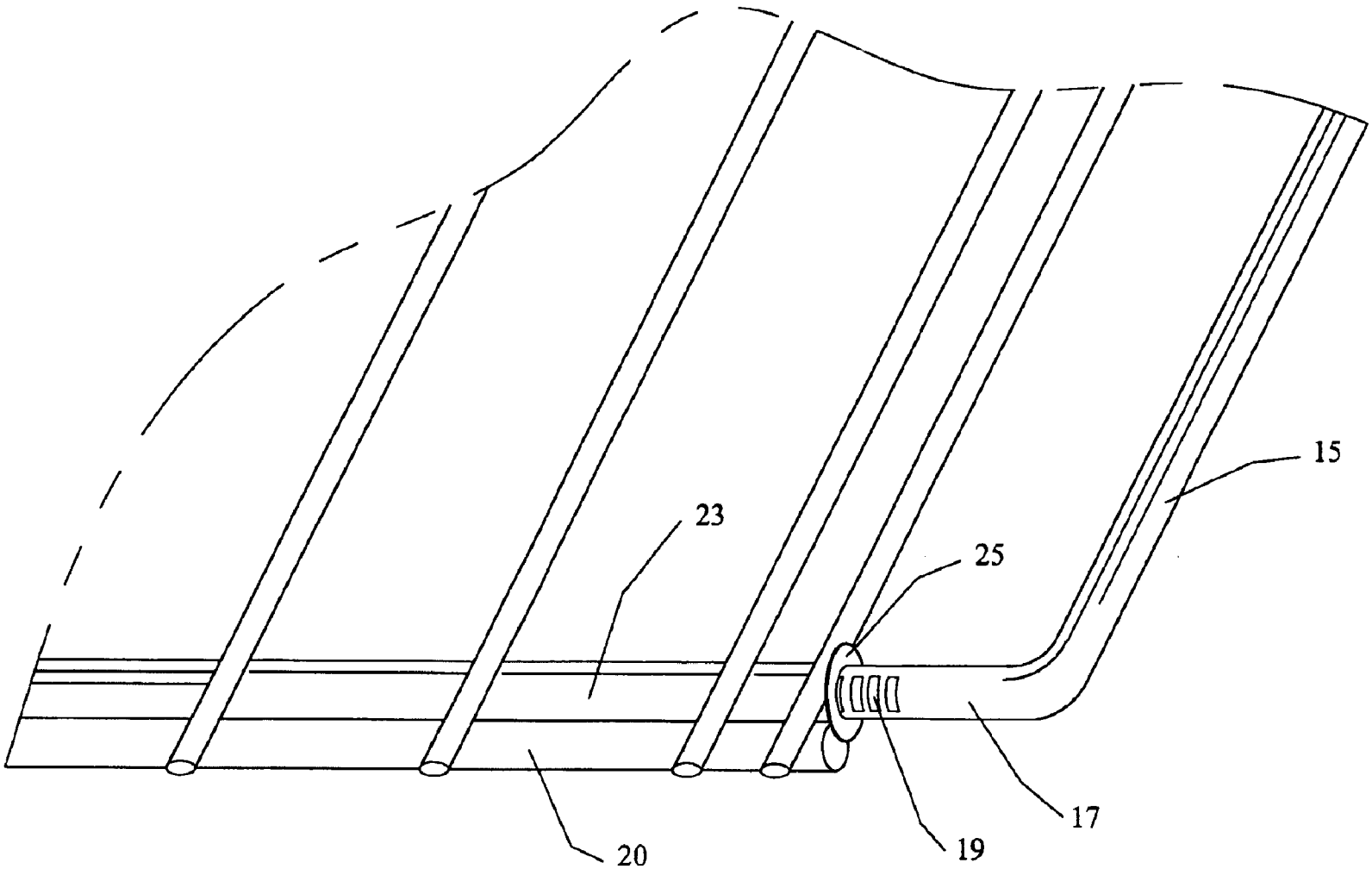
FIG. 11 is a sectional view showing a preferred means for adjusting the oven rack of the subject invention.

The legs 17 can slidably engage the frame in a number of ways. The means by which the legs engage the frame need only insure that a rack supported by the side rail 13 will not collapse under the weight of items placed on the rack. A preferred embodiment of a means by which the legs 17 slidably engage the leading edge 20 and the tail edge 22 of the frame of the rack of the subject invention is shown in FIG. 11. The legs 17 slide into channels along opposing inside edges of the frame. The channels capture and support the legs 17 along the frame 12. In this embodiment, the legs 17 are notched 19 and slide into cylindrical sleeves 23 along the leading edge 20 and tail edge 22 of the rack. Snap rings 25 encircle the legs and rest in a notch when the proper width of the rack is determined and prevents the legs 17 from moving further into the sleeve 23. The channels need not be cylindrical. Channels formed of square sleeves or using planar materials can accommodate ¼ steel stock legs 17 or modified legs that have been squared at the ends. Further, the channels do not have to be disposed on the inside of the frame but can be outside the frame as long as the channels do not interfere with use of the rack.

Figure 12:
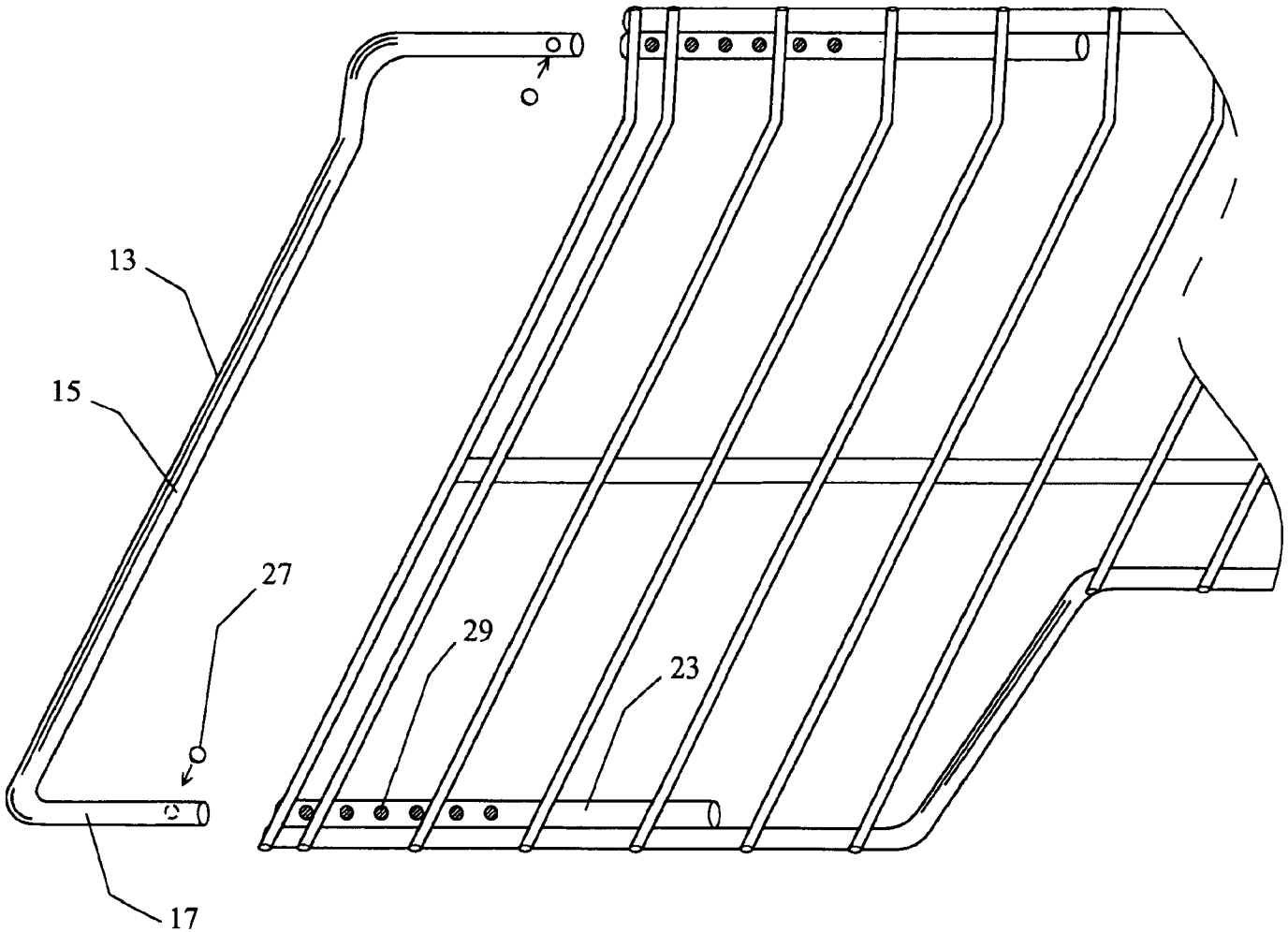
FIG. 12 is a sectional view showing another preferred means for adjusting the oven rack of the subject invention.

Another preferred embodiment of a means for adjusting the rack is shown in FIG. 12. In this embodiment, the legs 17 of a sliding side rail 13 are fitted with a spring-biased ball 27. The ball 27 engages apertures 29 in the sleeve 23 locking the leg 17 within the sleeve when the desired width of the rack is reached. Alternatively, the legs 17 can have a projection which engages a notch in a panel welded to the leading edge 20 and the tail edge 22 of the frame 12. The legs 17 slide into a channel formed by the frame 12 and the notched panel. The projection rests in a notch that provides a rack of the proper width for a selected oven.

Figure 2A:
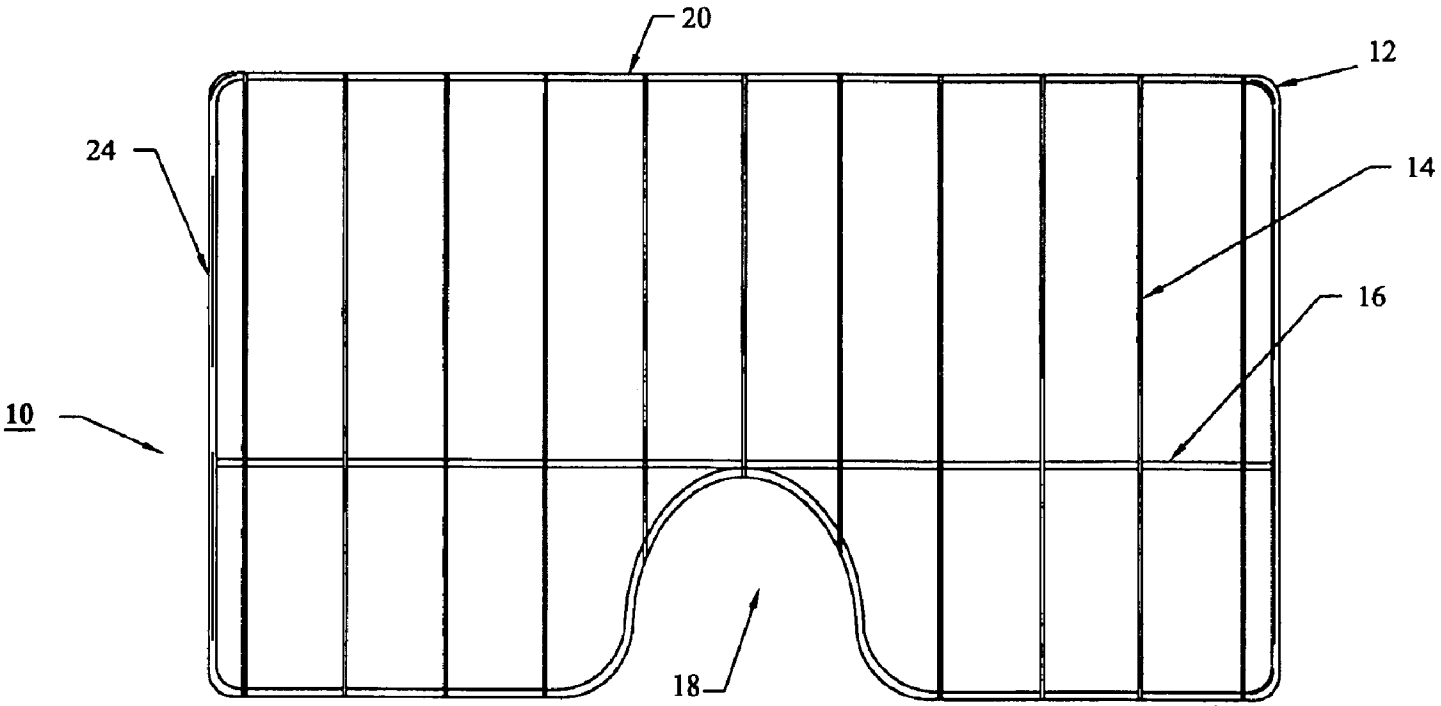
FIG. 2A is a top plan view of another preferred embodiment of the oven rack of the subject invention.
Figure 2B:
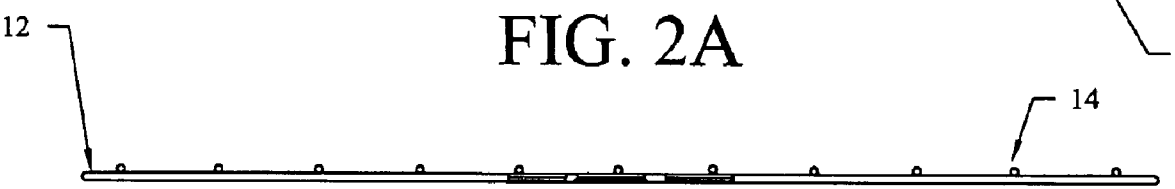
FIG. 2B is an elevational view of the tail edge of another preferred embodiment of the oven rack of the subject invention.
Figure 3A:
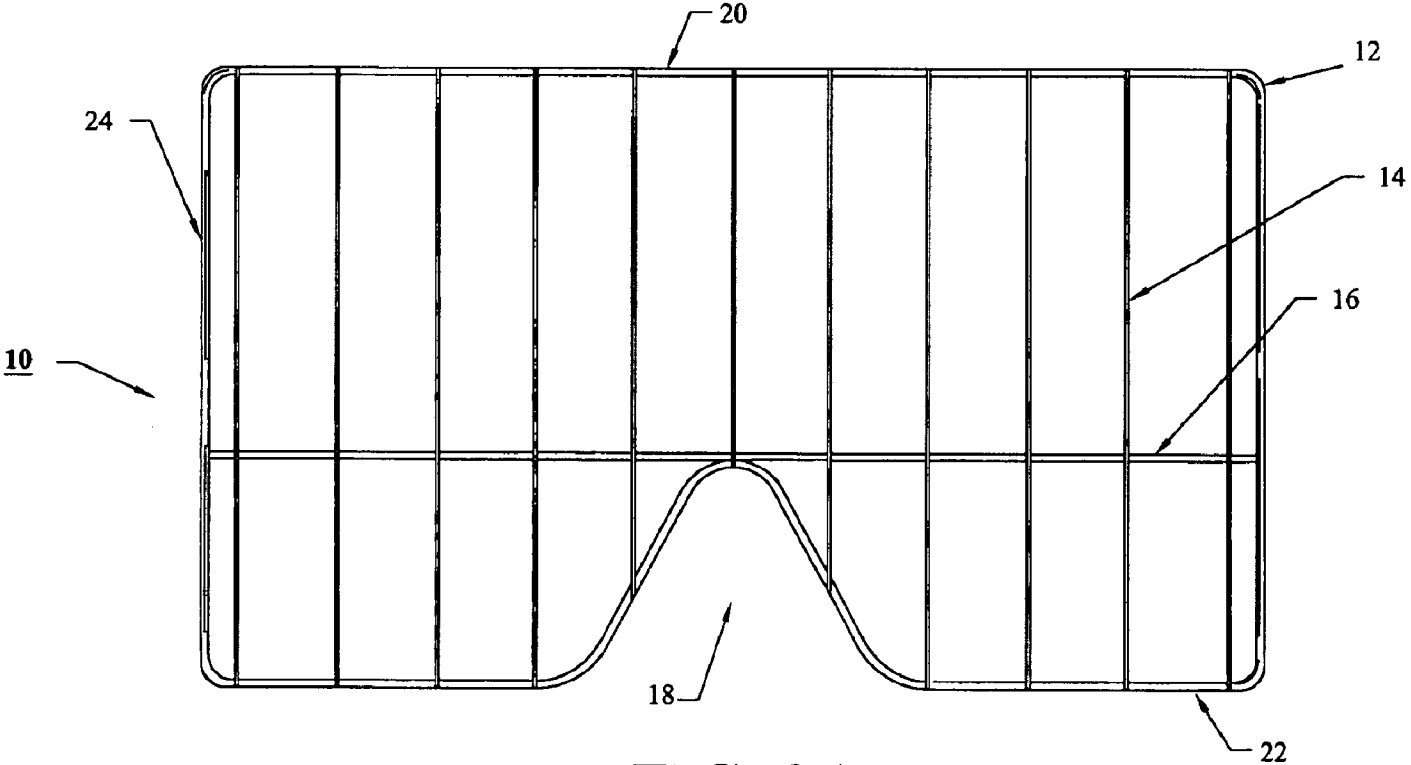
FIG. 3A is a top plan view of another preferred embodiment of the oven rack of the subject invention.
Figure 3B:
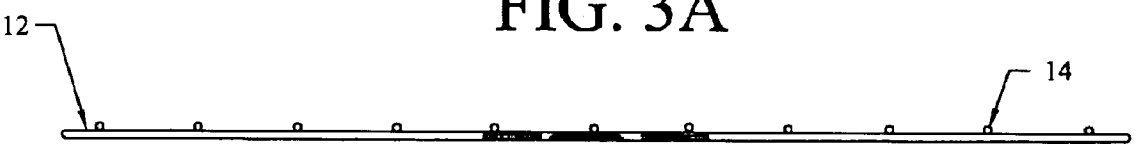
FIG. 3B is an elevational view of the tail edge of another preferred embodiment of the oven rack of the subject invention.
Figure 4A:
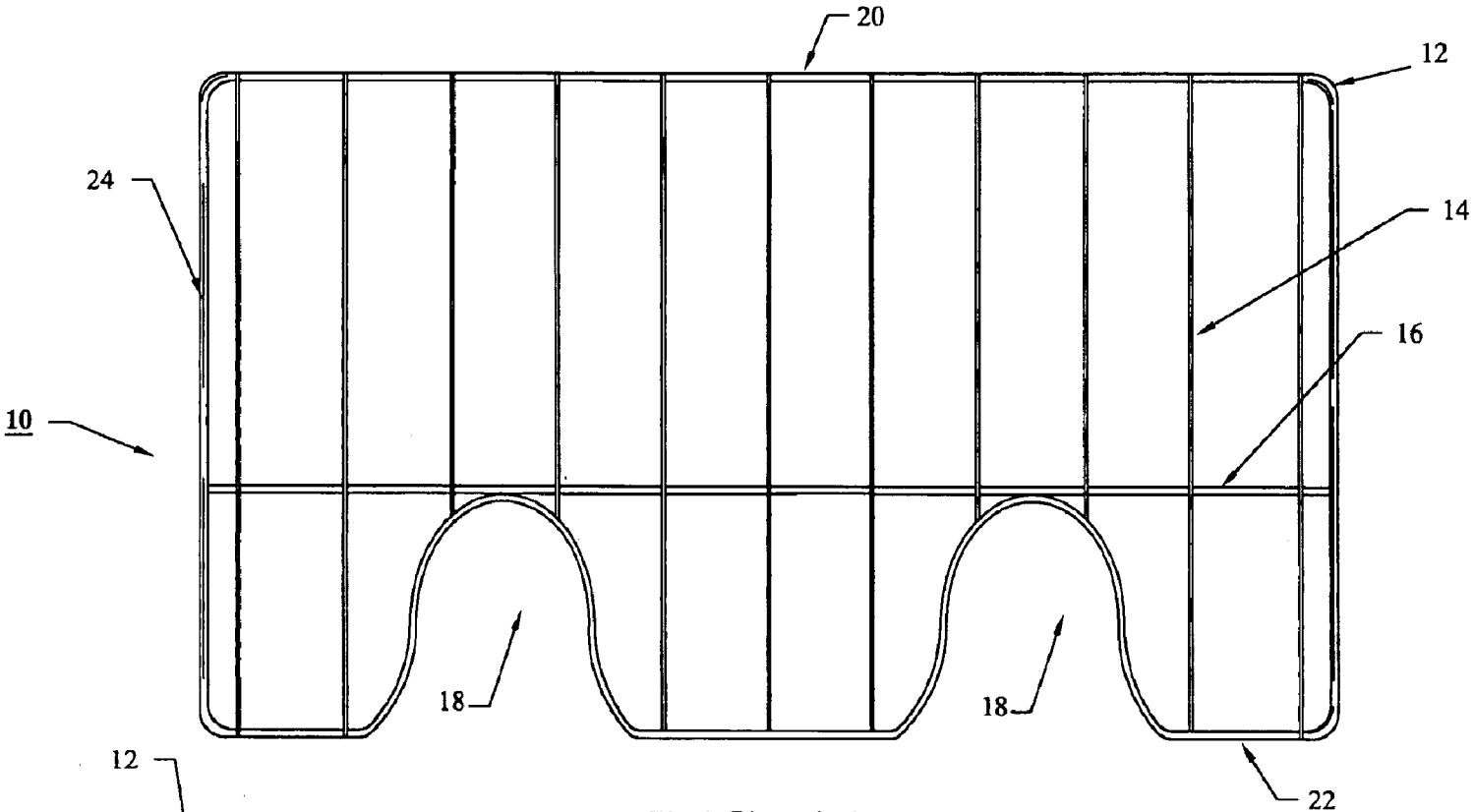
FIG. 4A is a top plan view of another preferred embodiment of the oven rack of the subject invention.
Figure 4B:
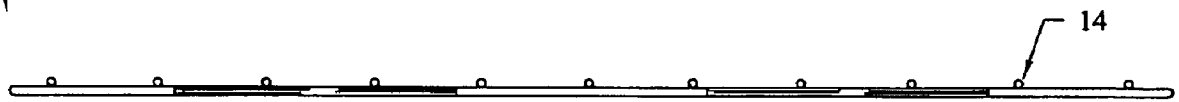
FIG. 4B is an elevational view of the tail edge of another preferred embodiment of the oven rack of the subject invention.

In the exemplified embodiment, the notch 18 is on the tail edge 22 near the center of the rack. The notch can be any size. The racks shown in the FIGS. are intended for use in a conventional home oven. Thus, the notch 18 measures from about 3 inches wide to about 9 inches wide and from about 3 inches deep to about 9 inches deep and, preferably from about 4 inches wide to about 6 inches wide and from about 4 inches deep to about 6 inches deep and, most preferably, the notch is about 5½ inches wide and about 5½ inches deep. This allows adequate space for a protected hand to grab an item from the rack. A larger notch could allow more than one item to be accessed through the notch or may be more suitable for larger industrial ovens or institutional uses. The notches can also be any shape. The notch in the rack of the exemplified embodiment is square, equal in length and width. The notch in the rack could be, for example, a half-circle FIG. 2A) or elliptical FIG. 3A). Further, the notch could be rectangular, unequal in length and width. Notches designed for the removal of industrial or institutional sized baking trays are also contemplated. Additionally, the notch 18 need not be placed near the center of the rack, nor does there need to be a single notch per rack. A notch placed nearer the side of the rack, and the side of the oven, still allows the items which span the notch to be removed without sliding the rack from the oven. Further, a rack for a specialized oven, for example a pizza oven, could have two or more notches along its periphery so a number of pizza stones could be placed in the oven. The size and placement of the notch does not effect the use of the rack for standard baking or cooking. Heavy roasters or cake pans are fully supported by the rack of the subject invention. In fact, the notch in the rack of the subject invention allows a cook to place a hand firmly under a heavy item while lifting it from the oven. The heavy item is better supported upon removal from the oven which is safer for the cook and others in the kitchen.

Figure 6A:
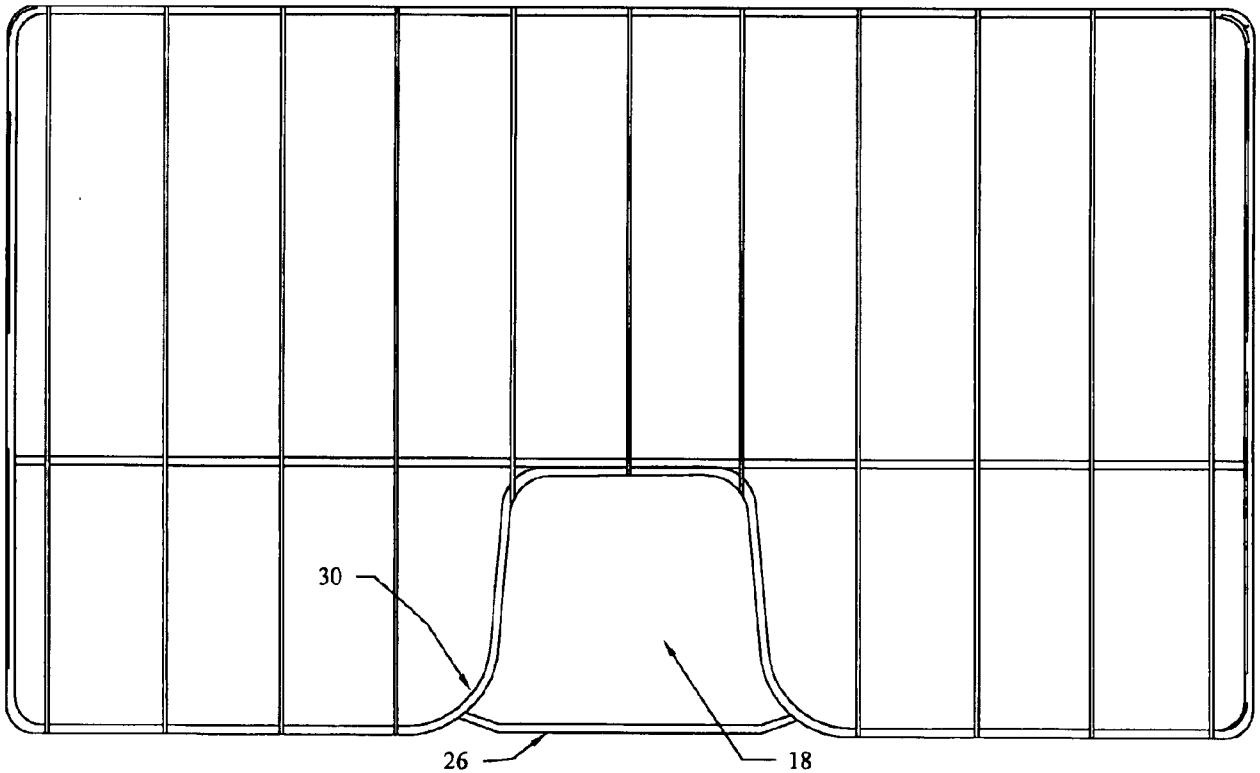
FIG. 6A is a top plan view of another preferred embodiment of the oven rack of the subject invention.
Figure 6B:
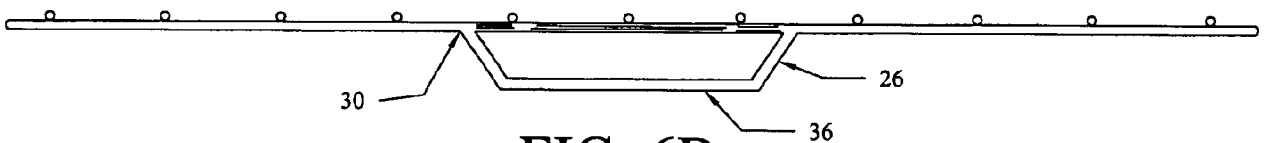
FIG. 6B is an elevational view of the tail edge of another preferred embodiment of the oven rack of the subject invention.

The rack can be pulled from the oven should the cook wish to check the cooking progress just as on a regular oven rack. The subject rack can further include a handle to assist in removing the rack from the oven. A preferred embodiment of the handle is shown in FIG. 6. The handle 26 is suspended from about ¼ inch to about four inches below the surface of the rack 27 (FIG. 6B). Positioning the handle below the rack's surface allows unobstructed access to the notch 18. Thus, a flat item placed on the rack of the subject invention having a dropped handle can be removed from the surface of the rack by accessing the item through the notch. In a particularly preferred embodiment, the handle is suspended from about ½ to about ¾ inches below the surface of the rack. When the grasp 36 of the handle is about ½–¾ inches below the surface of the rack it does not interfere with access or removal of items placed on the rack below.

The handle 26 can be a simple U-shaped bar suspended below the surface of the oven rack. In a specific embodiment, the handle, is a flattened U-shaped with each arm of the U being attached to an outer corner 30 of the notch 18 (FIG. 6A). The arms of the U are sufficient length to allow passage of a protected hand into the notch.

Figure 7A:
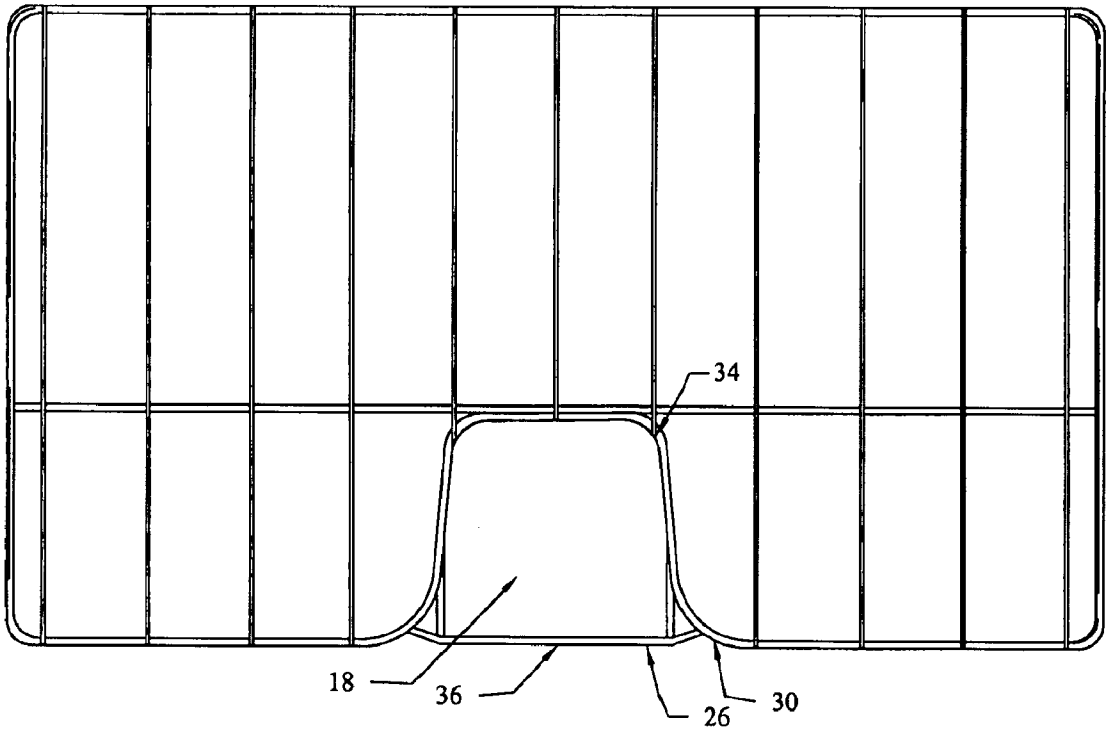
FIG. 7A is a top plan view of another preferred embodiment of the oven rack of the subject invention.
Figure 7B:
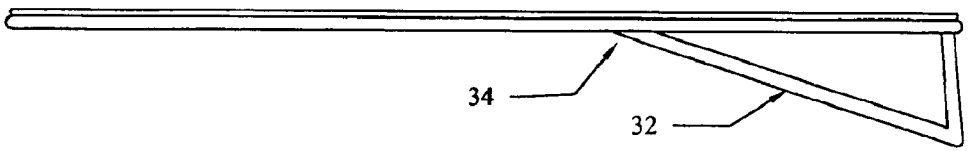
FIG. 7B is an elevational view of the side edge of another preferred embodiment of the oven rack of the subject invention.

An alternative embodiment of the handle of the rack of the subject invention includes a simple flattened U-shaped bar supported by braces 32 running from the inside corners of the notch 34 toward the periphery or tail edge of the rack (FIG. 7A). The arms of the U are attached to the rack at the outer edges of the notch 18. The arms of the U are from about ¼ inch to about four inches long and preferably about ¾ inches long. The braces 32 attach to the inner corners 34 of the notch on the oven rack and to the handle at the points of attachment of the arms of the U 28 and the grasp 36. Thus, the distance between the rack and the brace increases as one moves toward the tail edge 22 of the rack. The position of the braces 32 are seen most clearly in FIG. 7B.

Figure 8A:
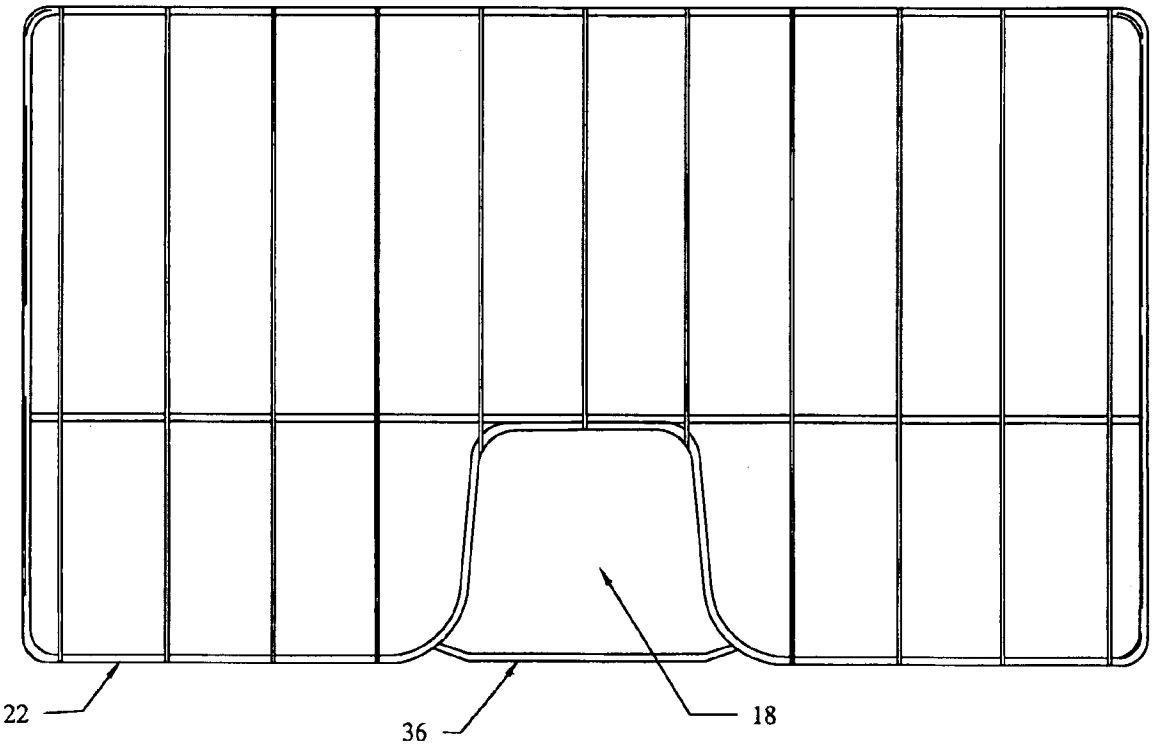
FIG. 8A is a top plan view of another preferred embodiment of the oven rack of the subject invention.
Figure 8B:
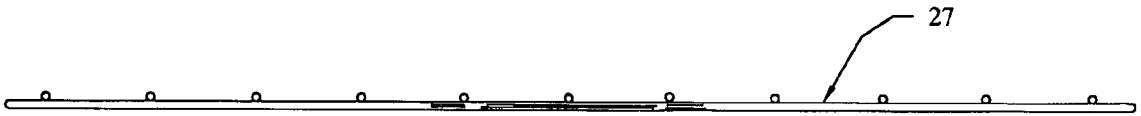
FIG. 8B is an elevational view of the side edge of another preferred embodiment of the oven rack of the subject invention.

Another embodiment of the handle of the rack of the subject invention includes a flattened U-shape handle on the same plane as the surface of the rack 27. The arms of the U are preferably about ¼ inch to ¾ inch long extending the grasp 36 of the handle at or past the periphery or tail edge 22 of the rack and toward the door of the oven a sufficient distance to allow a protected hand to slip through the handle and into the notch to access an item on the rack (FIGS. 8A and 8B). The handle should not interfere with closure of the oven door.

Figure 9A:
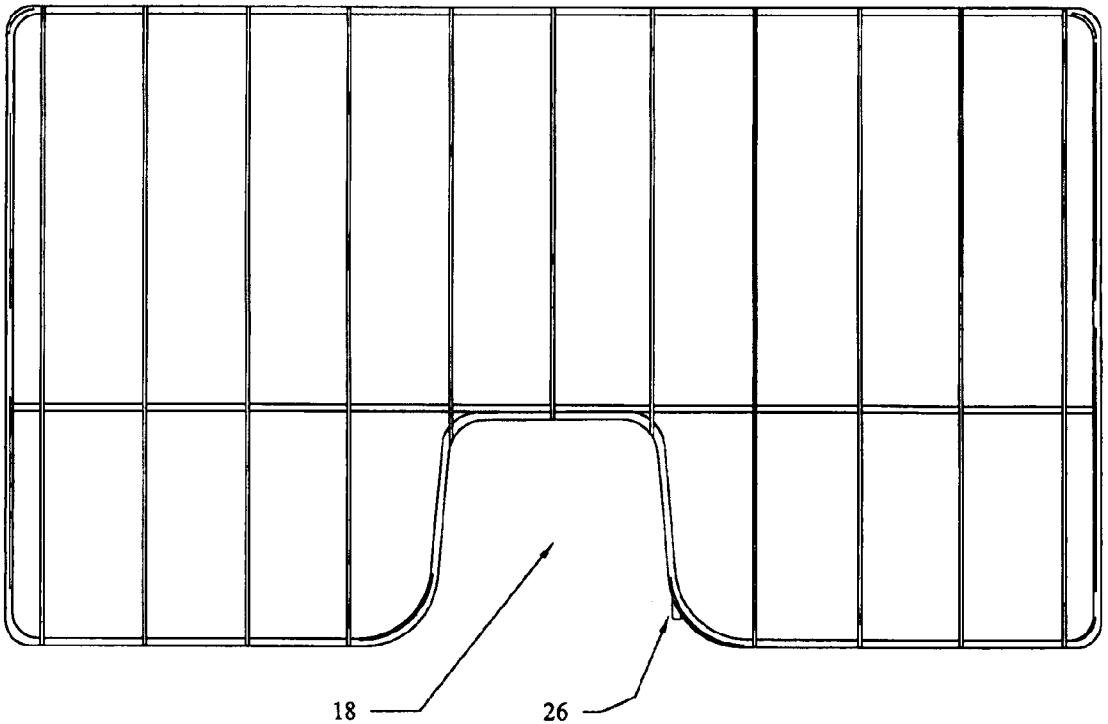
FIG. 9A is a top plan view of another preferred embodiment of the oven rack of the subject invention.
Figure 9B:
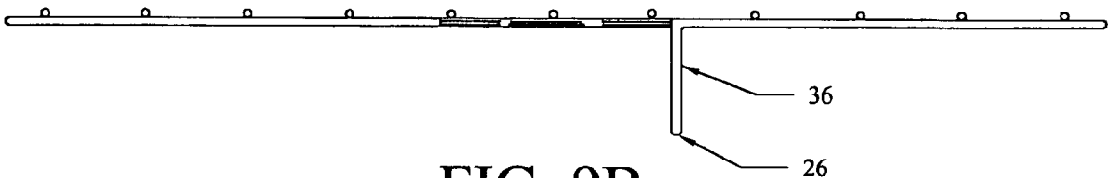
FIG. 9B is an elevational view of the tail edge of another preferred embodiment of the oven rack of the subject invention.

The handle 26 of the rack of the subject invention in the illustrated embodiments are flattened U-shapes. The subject handles however can be any shape, including but not limited to, rounded U-shapes, other pulls, knobs or simple bars. For example, a simple bar extending from the surface of the rack about ½ inch to about ¾ inch toward the bottom of the oven can act as a handle (FIGS. 9A and 9B).

The handles 26 on the rack of the subject invention can be made from the same material as the rack. For example, the handles can be fashioned from ¼ inch steel bars which are spot welded to the frame. Alternatively, the handles can be made of an insulated material to protect someone grasping the handle from burns. Suitable insulating materials include ceramics which can likewise be applied to the handle to provide insulation qualities.

The handles described are placed at the notch of the subject rack. Handles can be placed on the rack however anywhere on the edge of the rack. For example, handles placed on either side of the notch can extend either above or below the surface of the rack. Further, handles extending from the tail edge of the rack are suitable for use with the subject rack provided they do not interfere with the notch or interfere with closing the oven door.

The rack of the subject invention is safer than a regular oven rack when removing flat items from the oven. To remove a flat item from a regular oven rack, it is necessary to pull the rack partially out of the oven and reach behind the item to push the edge of the item over the lip of the rack. The rack is usually then slid back into the oven and the flat item is removed form the rack. This practice is unsafe because the partially removed rack is not fully supported and can tip falling form the oven or dumping hot food items. Further, the oven is left open for a period of time during this process leaving its hot surfaces accessible to small children. When a flat item is placed on the rack of the subject invention, traversing the notch, the item can be easily and safely removed by grabbing its edge in the notch.

Additionally, the rack of the subject invention provides access to items on the bottom rack without the fear of being burned. Little room is left between the top and bottom racks to grab the lip of a pan on the bottom rack. A cook can burn a hand or wrist on the upper rack while reaching past the rack to access items on the lower rack. The rack of the subject invention provides access to items on the lower rack through the notch preventing possible burns. Likewise, the rack of the subject invention can prevent "burning" when reaching into an ultra-cold (−20° C.) freezer.

Further, the rack of the subject invention requires that the oven be open only a short period of time. It is not necessary to partially remove the subject rack to adjust the cookware sitting on it when attempting to remove items from the oven. A flat item is easily removed by grabbing the edge of the item which transverses the notch. Thus, the oven door is open only briefly saving energy and assuring a more constant cooking temperatures.

It should be understood that the examples and embodiments described herein are for illustrative purposes only and that various modifications or changes in light thereof will be suggested to persons skilled in the art and are to be included within the spirit and purview of this application.

What is claimed is:

1. A rack for an oven, said rack comprising a frame supporting a plurality of bars, said frame having a periphery with at least one notch, said notch measuring from about 3 inches to about 9 inches wide and from about 3 inches to about 9 inches deep, said notch allowing adequate room to receive a protected hand of a user, said notch facing a door of said oven, and said notch near the center of said rack, wherein a flat item having an edge spanning said notch can be removed from said rack without having to pull said rack from said oven.

2. The rack of claim 1, wherein said rack further comprises a means for adjusting the size of said rack.

3. The rack of claims 2, wherein said means for adjusting the size of the rack comprises at least one side rail slidably engaging an edge of said frame, wherein said side rail allows said rack to be adjusted in size.

4. The rack of claim 3, wherein said side rail comprises a body and two legs, said legs slidably engaging opposing sides of said frame.

5. The rack of claim 4, wherein said legs slidably engage channels on said opposing sides of said frame.

6. The rack of claim 5, wherein said channels are sleeves.

7. The rack of claim 5, wherein said legs have notches to lock a portion of said legs outside said channel.

8. The rack of claim 5, wherein said channels have apertures and said legs have at least one protrusion, wherein the at least one protrusion engages the apertures.

9. The rack of claim 8, wherein said at least one protrusion is a spring-biased ball.

10. A rack for an oven, said rack comprising a frame supporting a plurality of bars, said frame having a periphery with at least one notch, said notch measuring from about 3 inches to about 9 inches wide and from about 3 inches to about 9 inches deep, said notch allowing adequate room to receive a protected hand of a user, said notch facing a door of said oven, and said notch near the center of said rack, wherein a flat item having an edge spanning said notch can be removed from said rack without having to pull said rack from said oven, and a side rail slidably engaging an edge of said frame to allow said rack to be adjusted in size, said side rail comprising a body and two legs, said legs slidably engaging sleeves on opposing edges of said frame, wherein said legs have notches to lock a portion of said legs outside said sleeve, thereby fixing said side rail at a distance away from said edge of said frame adjusting the size of said rack.

11. A rack for an oven, said rack comprising a frame supporting a plurality of bars, said frame having a periphery with at least one notch, said notch measuring from about 3 inches to about 9 inches wide and from about 3 inches to about 9 inches deep, said notch allowing adequate room to receive a protected hand of a user, said notch facing a door of said oven, and said notch near the center of said rack, wherein a flat item having an edge spanning said notch can be removed from said rack without having to pull said rack from said oven, and a side rail slidably engaging an edge of said frame to allow said rack to be adjusted in size, said side rail comprising a body and two legs, said legs slidably engaging sleeves on opposing edges of said frame, wherein said legs have a spring-biased balls to engage apertures in said sleeves, thereby fixing said side rail at a distance away from said edge of said frame adjusting the size of said rack.

* * * * *